US008422926B2

(12) United States Patent
LeFevre et al.

(10) Patent No.: US 8,422,926 B2
(45) Date of Patent: Apr. 16, 2013

(54) FIXING DEVICES INCLUDING LOW-VISCOSITY RELEASE AGENT APPLICATOR SYSTEM AND METHODS OF FIXING MARKING MATERIAL TO SUBSTRATES

(75) Inventors: Jason M. LeFevre, Penfield, NY (US); Michael Jon Levy, Webster, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 316 days.

(21) Appl. No.: 12/855,054

(22) Filed: Aug. 12, 2010

(65) Prior Publication Data

US 2012/0039645 A1 Feb. 16, 2012

(51) Int. Cl.
*G03G 15/20* (2006.01)

(52) U.S. Cl.
USPC ..... 399/325

(58) Field of Classification Search ..... 399/325, 399/328
See application file for complete search history.

(56) References Cited

U.S. PATENT DOCUMENTS

| | | | | |
|---|---|---|---|---|
| 4,751,548 | A * | 6/1988 | Lawson | 399/325 |
| 4,887,964 | A * | 12/1989 | Takeuchi | 432/60 |
| 5,625,859 | A * | 4/1997 | Moser | 399/325 |
| 6,393,245 | B1 * | 5/2002 | Jia et al. | 399/307 |
| 7,322,689 | B2 | 1/2008 | Kohne et al. | |
| 7,402,371 | B2 | 7/2008 | Sacripante et al. | |
| 7,407,278 | B2 | 8/2008 | Kohne et al. | |
| 7,494,757 | B2 | 2/2009 | Sacripante et al. | |
| 7,547,499 | B2 | 6/2009 | Veregin et al. | |
| 7,682,014 | B2 | 3/2010 | Snyder et al. | |
| 2007/0025741 | A1 * | 2/2007 | Kitano et al. | 399/1 |
| 2009/0009573 | A1 | 1/2009 | Larson et al. | |
| 2009/0021550 | A1 | 1/2009 | Leighton et al. | |
| 2009/0102906 | A1 | 4/2009 | Phillips et al. | |
| 2010/0045720 | A1 | 2/2010 | Williams et al. | |

OTHER PUBLICATIONS

James Williams et al.; Temperature Leveling Roller and Pressure Nip Assembly; U.S. Appl. No. 12/617,255, filed Nov. 12, 2009.

Wacker Chemical Corporation; Material Safety Data Sheet; May 27, 2010; Adrian, MI USA.

* cited by examiner

*Primary Examiner* — Walter L Lindsay, Jr.
*Assistant Examiner* — Frederick Wenderoth
(74) *Attorney, Agent, or Firm* — Ronald E. Prass, Jr.; Prass LLP

(57) ABSTRACT

Fixing devices for fixing marking material to a substrate, printing apparatuses and methods of fixing marking material to a substrate are provided. An exemplary embodiment of the fixing devices includes a first roll including an outer surface; a second roll forming a fixing nip with the outer surface of the first roll at which is received a pre-heated substrate on which marking material is disposed; a release agent applicator system including a supply of a release agent having a viscosity of from about 10 cST to about 300 cST, and a release agent applicator for applying the release agent to the outer surface of the first roll; and a thermal energy source for heating the outer surface of the first roll to a temperature of less than a boiling point of the release agent. The first roll and second roll are operable to apply heat and a pressure of at least about 500 psi to the pre-heated substrate and marking material at the fixing nip to fix the marking material to the substrate.

19 Claims, 3 Drawing Sheets

FIXING DEVICES INCLUDING LOW-VISCOSITY RELEASE AGENT APPLICATOR SYSTEM AND METHODS OF FIXING MARKING MATERIAL TO SUBSTRATES

RELATED APPLICATIONS

This application is related to the applications entitled "MULTI-STAGE FIXING SYSTEMS, PRINTING APPARATUSES AND METHODS OF FIXING MARKING MATERIAL TO SUBSTRATES" Ser. No. 12/855,011; "FIXING DEVICES FOR FIXING MARKING MATERIAL TO A WEB WITH CONTACT PRE-HEATING OF WEB AND MARKING MATERIAL AND METHODS OF FIXING MARKING MATERIAL TO A WEB" Ser. No. 12/855,036; "FIXING DEVICES INCLUDING CONTACT PRE-HEATER AND METHODS OF FIXING MARKING MATERIAL TO SUBSTRATES" Ser. No. 12/855,066; "FIXING SYSTEMS INCLUDING IMAGE CONDITIONER AND IMAGE PRE-HEATER AND METHODS OF FIXING MARKING MATERIAL TO SUBSTRATES" Ser. No. 12/855,078; "FIXING DEVICES INCLUDING EXTENDED-LIFE COMPONENTS AND METHODS OF FIXING MARKING MATERIAL TO SUBSTRATES" Ser. No. 12/855,106; and "LOW ADHESION COATINGS FOR IMAGE FIXING" Ser. No. 12/855,140, each of which is filed on the same date as the present application, commonly assigned to the assignee of the present application, and incorporated herein by reference in its entirety.

BACKGROUND

In printing processes, marking material is applied to a substrate to form an image. The image can be heated while pressure is applied to the substrate and marking material by fixing members to fix the marking material to the substrate. In such processes, it is desirable to avoid the marking material adhering to surfaces of the fixing members and degrading image quality, as well as to be able to achieve good substrate stripping performance. It may also be desirable that the substrate be suitable for post-processing operations.

It would be desirable to provide fixing devices, printing apparatuses and methods for fixing marking material to a substrate that can provide prints with good image quality and which are suitable for post-processing operations.

SUMMARY

Fixing devices for fixing marking material to a substrate, printing apparatuses and methods of fixing marking material to a substrate are provided. An exemplary embodiment of the fixing devices comprises a first roll including an outer surface; a second roll forming a fixing nip with the outer surface of the first roll at which is received a pre-heated substrate on which marking material is disposed; a release agent applicator system comprising a supply of a release agent having a viscosity of from about 10 cST to about 300 cST, and a release agent applicator for applying the release agent to the outer surface of the first roll; and a thermal energy source for heating the outer surface of the first roll to a temperature of less than a boiling point of the release agent. The first roll and second roll are operable to apply heat and a pressure of at least about 500 psi to the pre-heated substrate and marking material at the fixing nip to fix the marking material to the substrate.

DRAWINGS

DETAILED DESCRIPTION

Figure 1:
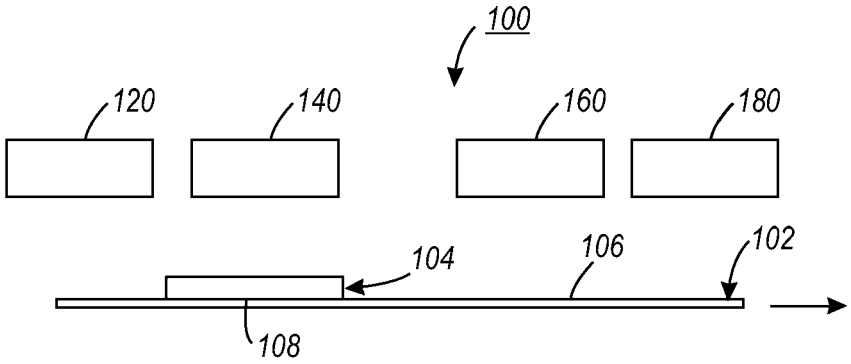
FIG. 1 depicts an exemplary embodiment of a printing apparatus.

The disclosed embodiments include fixing devices for fixing marking material to a substrate. An exemplary embodiment of the fixing devices comprises a first roll including an outer surface; a second roll forming a fixing nip with the outer surface of the first roll at which is received a pre-heated substrate on which marking material is disposed; a release agent applicator system comprising a supply of a release agent having a viscosity of from about 10 cST to about 300 cST, and a release agent applicator for applying the release agent to the outer surface of the first roll; and a thermal energy source for heating the outer surface of the first roll to a temperature of less than a boiling point of the release agent. The first roll and second roll are operable to apply heat and a pressure of at least about 500 psi to the pre-heated substrate and marking material at the fixing nip to fix the marking material to the substrate.

The disclosed embodiments further include printing apparatuses. An exemplary embodiment of the printing apparatuses comprises a marking device for applying marking material to a substrate; a pre-heating device for pre-heating the substrate and marking material; and a fixing device for fixing the marking material to the pre-heated substrate. The fixing device comprises a first roll including an outer surface; a second roll forming a fixing nip with the outer surface of the first roll at which the pre-heated substrate is received; a release agent applicator system including a supply of a release agent having a viscosity of from about 10 cST to about 300 cST, and a release agent applicator for applying the release agent to the outer surface of the first roll; and a thermal energy source for heating the outer surface of the first roll to a temperature of less than a boiling point of the release agent. The first roll and second roll are operable to apply heat and a pressure of at least about 500 psi to the pre-heated substrate and marking material at the fixing nip to fix the marking material to the substrate.

The disclosed embodiments further include methods of fixing marking material to a substrate. An exemplary embodiment of the methods comprises applying a marking material to a substrate with a marking device; pre-heating the substrate and marking material with a pre-heating device; feeding the pre-heated substrate to a fixing nip formed by an outer surface of a first roll and a second roll; applying a release agent having a viscosity of from about 10 cST to about 300 cST to the outer surface of the first roll using a release agent applicator system; heating the outer surface of the first roll to a temperature of less than a boiling point of the release agent with a thermal energy source; and applying heat and a pressure of at least about 500 psi to the pre-heated substrate and marking material at the fixing nip with the heated first roll and second roll to fix the marking material to the pre-heated substrate.

Printing apparatuses can utilize dry toner materials to form an image on a substrate. Some printing apparatuses include a contact fixing device having a fixing roll and a pressure roll, which form a fixing nip. A toner image formed on a substrate is fixed or fused by applying sufficient thermal energy and pressure to the substrate and toner image by contact with the fixing roll and pressure roll at the fixing nip.

To reduce the energy consumption in such contact fixing devices and enable longer lifetimes of the fixing devices, it is desirable to reduce the fixing temperatures of toners onto substrates. For example, a fixing temperature range of about 80° C. to about 100° C. may be desirable for some toners. The use of these lower temperatures with applied pressure to fix toner images on substrates may be referred to as "warm pressure fusing." It is also desirable to be able to operate at a suitably-high process speed when these reduced fixing temperatures are used in fixing devices.

To achieve reduced fixing temperatures in contact fixing devices, a substrate to which toner has been applied can be pre-heated before the substrate enters the fixing nip. The substrate can be pre-heated using a non-contact pre-heating device, i.e., a heating device that does not utilize conductive heating to heat the substrate. For a contact fixing device, the toner should not transfer or offset onto the fixing roll, referred to as "hot offset" or "cold offset," depending on whether the temperature is below the fixing temperature of the substrate (cold offset), or whether the toner offsets onto a fixing roll at a temperature above the fixing temperature of the toner (hot offset). Offset can result in the marking material transferred to the fixing roll subsequently re-transferring to another substrate and producing unacceptable images. In contact fixing devices, the toner images resulting from fixing should have sufficient durability, i.e., adherence or fix to the substrate, while image offset onto the fixing roll is minimized or avoided.

It has been determined that a controlled amount of a release agent can be applied to the outer surface of the fixing roll in order to produce images with sufficient image durability, while avoiding image offset, with the use of lower fixing temperatures. The release agent is formulated to prevent adherence of toner to the fixing roll and to assist in stripping of the substrate from the fixing roll following fixing.

In light of these considerations, fixing devices for fixing marking material to a substrate; printing apparatuses including a fixing device; and methods of fixing marking material to a substrate are provided. The fixing devices include a fixing roll and a release agent applicator for applying a liquid release agent to the fixing roll. The release agent applicator allows the application of a controlled amount of release agent to the fixing roll to produce robust images on the substrate without undesirable image offset. In the fixing devices, the controlled amount of the release agent applied to the fixing roll can be significantly reduced as compared to the amount of oil that typically is used in contact fixing devices that operate at higher fixing temperatures. The use of lower amounts of the release agent in the fixing devices reduces release agent consumption and also allows release agent carryout rates that are within defined boundaries for post-processing operations on the prints to be achieved for different types of substrates.

FIG. 1 depicts an exemplary embodiment of a printing apparatus 100 for forming images on a substrate. The substrate can be in the form a sheet or a continuous web. As used herein, the term "printing apparatus" can encompass various types of apparatuses that form images on substrates, such as printers, copy machines, facsimile machines, multi-function machines, and the like. In embodiments, the printing apparatus 100 can be used in xerographic printing processes. The printing apparatus 100 includes a feeding device 120, a marking device 140, a pre-heating device 160 and a fixing device 180. A substrate 102 is fed from the feeding device 120 to the marking device 140 to apply marking material 104 to a front surface 106 of the substrate 102, the substrate 102 and marking material 104 are pre-heated by the pre-heating device 160, and then the pre-heated substrate 102 is advanced to the fixing device 180 to fix the marking material 104 to the front surface 106. After advancing through the fixing device 180, the substrate 102 can be subjected to post-processing operations.

The marking device 140 can have any suitable configuration for applying marking material to the substrate 102. The marking material comprises dry toner particles, and may also comprise carrier particles and one or more additives. The marking device 140 can be constructed to apply marking material directly to the substrate 102 to form images. In other embodiments, the marking device 140 can be constructed to apply marking material to an intermediate member, such as a drum or belt, and then to transfer images from the intermediate member to the substrate 102. The marking device 140 can include multiple marking stations arranged in series along the process direction of the substrate 102. The marking stations can apply different colors of marking material, such as black, cyan, magenta and yellow marking materials, respectively, to the front surface 106 of the substrate 102 to form a color image. The marking device 140 can also produce monochromatic images. While the marking device 140 is described as applying marking material to one surface of the substrate 102, embodiments of the printing apparatus 100 may be configured to produce duplex prints.

The substrate 102 and marking material 104 may or may not be actively heated before reaching the pre-heating device 160. The pre-heating device 160 is provided in the printing apparatus 100 to pre-heat the substrate 102 and marking material 104 on the front surface 106 to achieve a sufficiently-high temperature at the interface 108 between the substrate 102 and marking material 104 to soften the marking material 104 before the substrate 102 is advanced to the fixing device 180. For example, embodiments of the pre-heating device 160 may achieve a temperature at the interface 108 of about 50° C. to about 100° C., such as about 50° C. to about 90° C. When the substrate 102 and marking material 104 are pre-heated to a temperature of less than 100° C., problems caused by the vaporization of water contained in print media, including damage to the media (blistering) and/or damage to the images (e.g., blow-off or icicles), can be avoided in the printing apparatus 100.

The pre-heating device 160 can include any suitable heating device that can pre-heat the substrate 102 and marking material 104 to the desired temperature. For example, the pre-heating device 160 can include at least one non-contact heating device, such as at least one radiant heating device that emits radiant energy onto the substrate 102 and marking material 104, e.g., a flash lamp, which emits short-duration, high-intensity radiant energy, or a radiant heater, such as a lamp, which emits radiant energy continuously; or at least one convective heating device, such as a forced hot air or steam emitting device, that applies a heated gas or vapor to the substrate 102 and marking material 104; or combinations of different types of these devices.

The fixing device 180 is constructed to heat the pre-heated substrate 102 and marking material 104 to a sufficiently-high temperature with the application of pressure to cause the marking material 104 to coalesce and provide adequate adhesion of the image to the substrate 102 for uses of the print.

Figure 2:
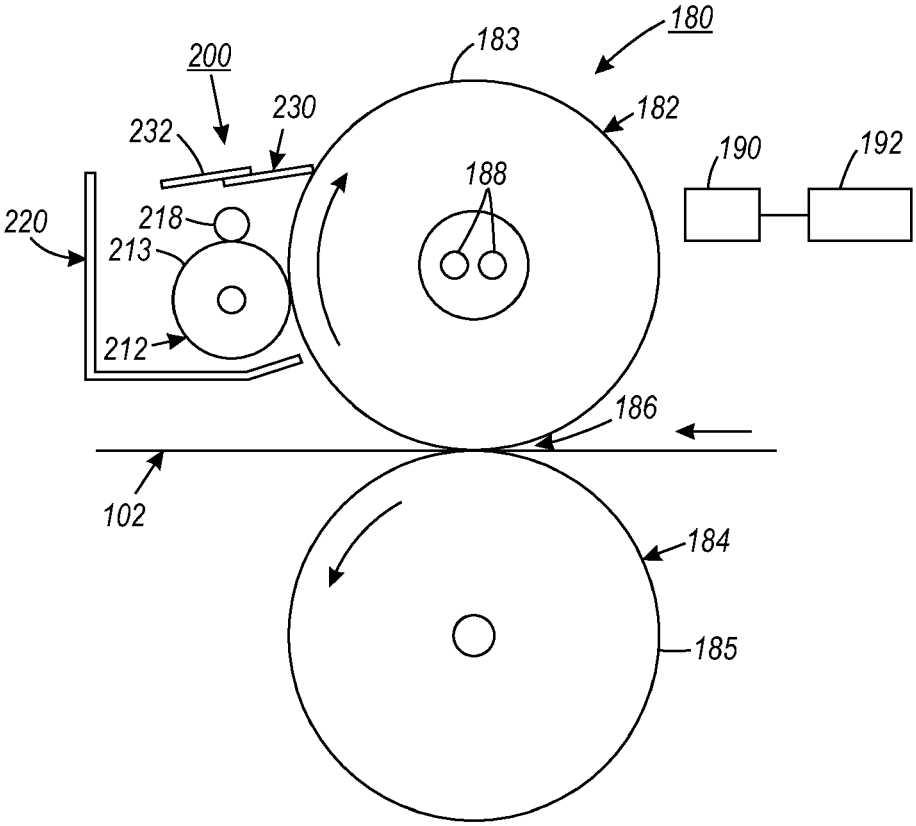
FIG. 2 depicts an exemplary embodiment of a fixing device including a release agent applicator system.

An exemplary embodiment of the fixing device 180 is shown in FIG. 2. The illustrated fixing device 180 includes a fixing roll 182 and a pressure roll 184, which form a nip 186. The substrate 102 is fed to the nip 186 at which the substrate 102 and marking material are subjected to heating and applied pressure by the fixing roll 182 and pressure roll 184.

The fixing roll 182 can be internally and/or externally heated by a thermal energy source. As shown, the thermal energy source can include one or more internal heating elements 188, such as one or more axially-extending lamps, which are powered to heat the outer surface 183 of the fixing roll 183 to the desired temperature, e.g., a temperature set point. A power supply 190 is connected in a conventional manner to the heating elements 188. The power supply 190 is connected to a controller 192 configured to control the supply of power to the heating elements 188. In other embodiments, the outer surface 183 of the fixing roll 182 can be externally heated by a thermal energy source utilizing conduction, convection and/or radiation.

In embodiments, the outer surface 183 of the fixing roll 182 can be comprised of a relatively-hard material, such as a metallic material or ceramic material. For example, the fixing roll 182 can comprise an aluminum substrate that has been subjected to anodizing to convert the surface region of the substrate, which includes the outer surface 183, to porous anodized aluminum (aluminum oxide). The pores of the anodized surface region can be impregnated with a suitable fluid to seal the open pores. For example, the open pores can be impregnated with a lubricating substance, such as polytetrafluoroethylene (Teflon®), or the like, to seal the pores. In this process, the lubricant is encapsulated within pores of the substrate. The resulting outer surface 183 provides desirable hardness and release properties. Following the sealing process, the outer surface 183 can be polished to a smooth finish for better release agent transfer properties.

The pressure roll 184 can comprise a solid (non-deformable) core and a deformable polymeric material overlying the core and forming the outer surface 185. For example, the polymeric material can be polyurethane. The polymeric material can be applied as a single layer, or as two or more layers. Different layers of multi-layer constructions can have a different composition and properties from each other, e.g., a different elastic modulus.

The outer surface 183 of the fixing roll 182 is heated to a fixing temperature suitable for fixing the type of marking material applied to the substrate 102. The substrate 102 may comprise light-weight to heavy-weight paper, which may be coated or uncoated. The amount of pressure applied to the substrate 102 at the fixing nip 186 can range from about 500 psi to about 2500 psi, for example.

In the printing apparatus 100 with continuous feeding of the substrate 102, high print speeds, such as about 400 fpm to about 500 fpm, can be used for different types of substrates. The pre-heated temperature of the substrate 102 produced by the pre-heating device 160 and the fixing temperature used in the fixing device 180 can be selected for different substrate types. For example, for a heavy-weight substrate 102 (e.g., heavy-weight coated or uncoated paper), the pre-heating temperature and/or fixing temperature can be increased as compared to the pre-heating temperature and fixing temperature used for a light-weight substrate 102 (e.g., light-weight paper).

Figure 3:
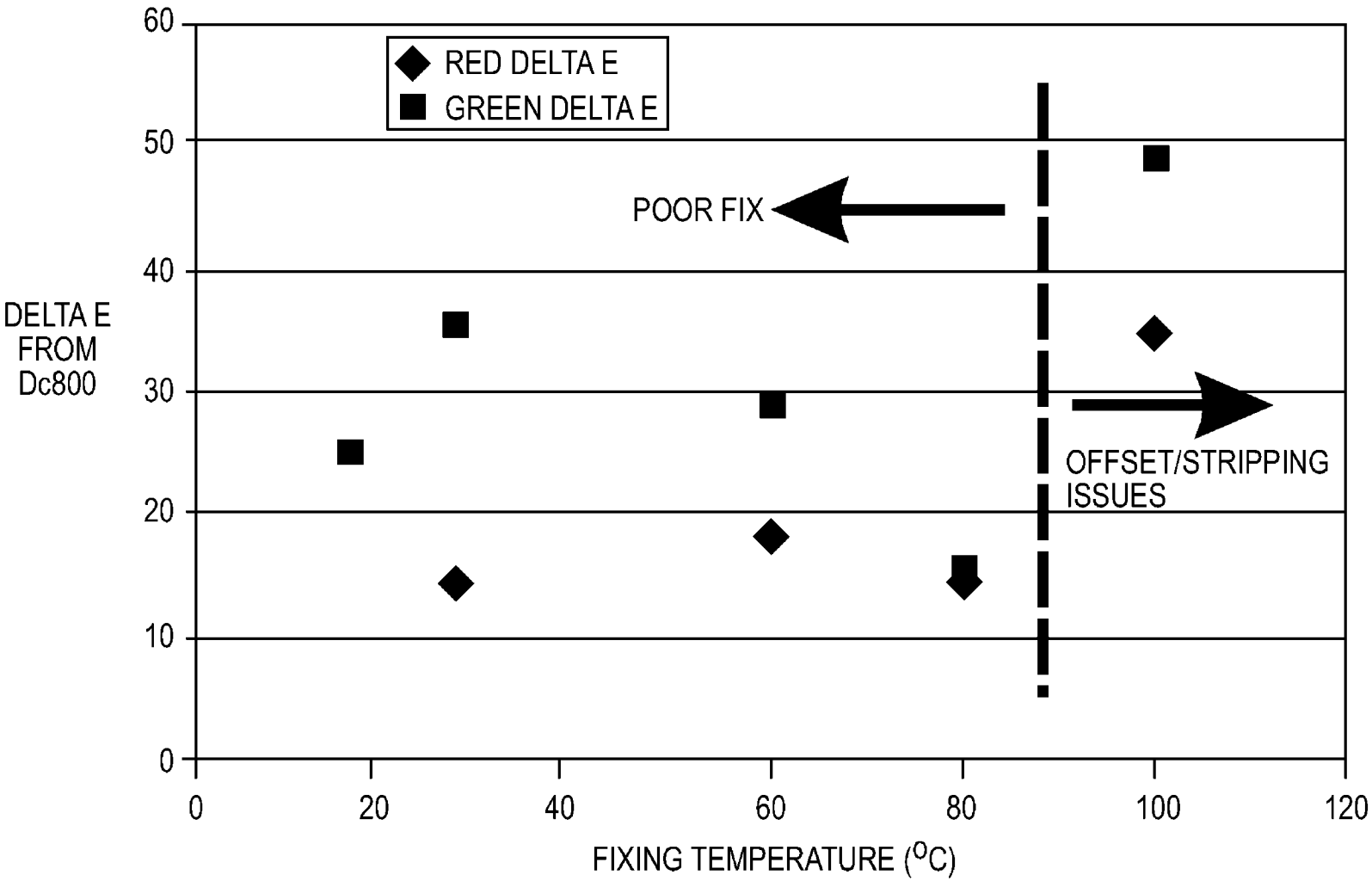
FIG. 3 shows a plot illustrating color space for uncoated paper versus fixing temperature for toner without the use of a release agent on the fixing roll.

It has been determined that poor fixing of dry toner onto paper and offset/stripping problems may occur when a release agent is not applied to the outer surface of the fixing roll of the fixing device, when the fixing roll is operated in the temperature range of about 80° C. to about 100° C. FIG. 3 shows a plot illustrating test results for evaluating color space. In the testing, images are scanned and compared to a standard target. The images are on 90 gsm weight uncoated paper. The fixing temperature used for toner having a melting temperature of about 90° C. at a nip pressure of 2500 psi without the use of a release agent is shown. For the testing, it is desirable that the "Delta E" value between the target being measured and the standard (DC800) target be minimized. The test results indicate that at fixing temperatures below about 90° C., poor fixing occurs on the paper, while at fixing temperatures above about 90° C., image offset and stripping problems occur.

Figure 4:
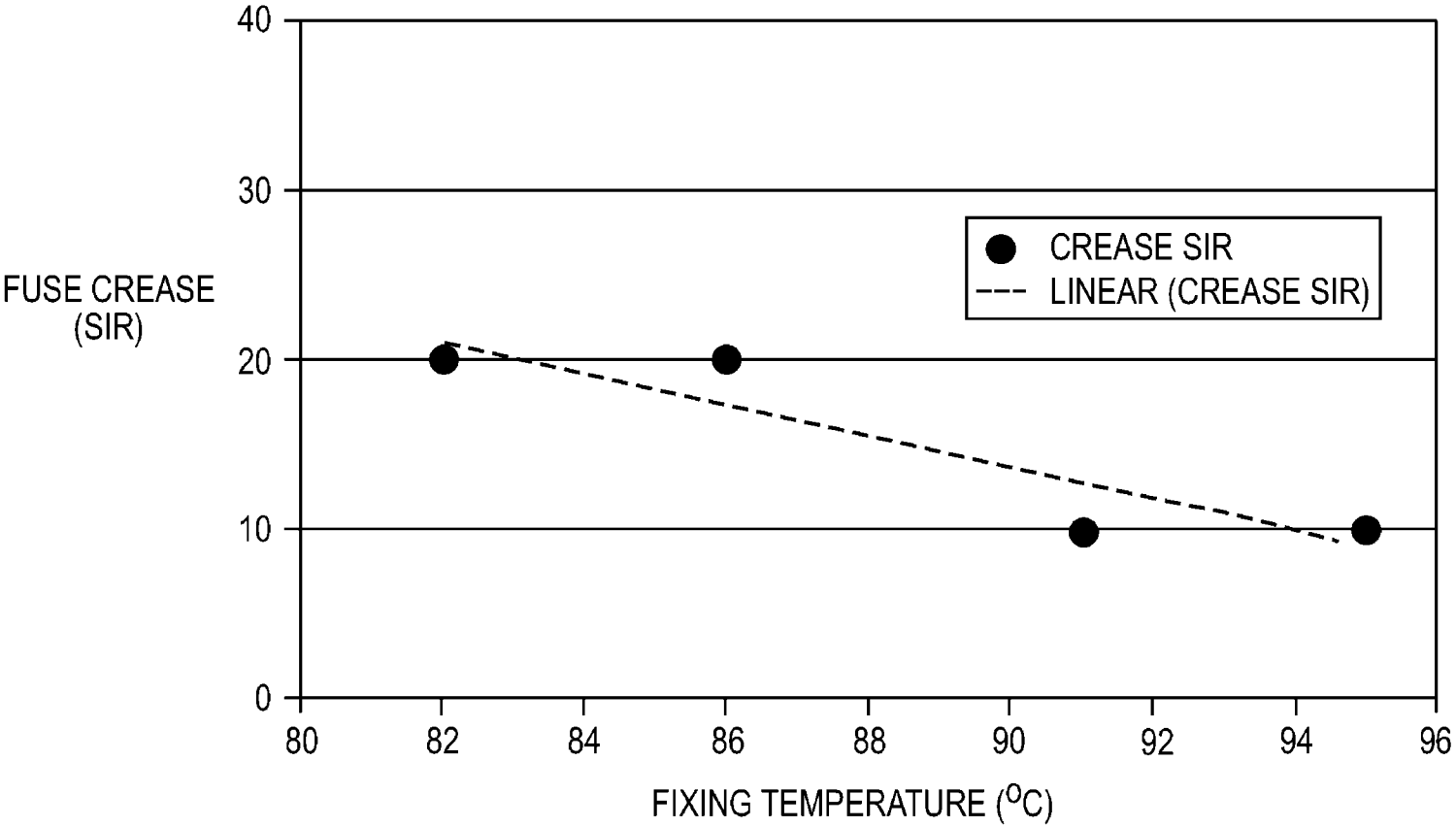
FIG. 4 shows a plot illustrating the fuse crease versus fixing temperature for toner onto uncoated paper with the use of a release agent on the fixing roll.

FIG. 4 illustrates the improvement in fixing performance achieved by applying a release agent to the outer surface of the fixing roll of the fixing device using the same paper, toner and nip pressure. FIG. 4 shows a plot illustrating the fuse crease value versus fixing temperature for toner material with the use of a release agent on the fixing roll. In the plots, "SIR" is a standard image reference. The "LINEAR (CREASE SIR)" line is a line fit to the "CREASE SIR" data points. As shown, good adhesion of the toner is achieved at a fixing temperature of at least about 90° C., based on a value on the SIR scale of <15 being considered to be acceptable in this testing.

In light of advantageous effects that can be provided by using a release agent, the fixing device 180 shown in FIG. 2 includes a release agent applicator system 200 for applying a release agent to the outer surface 183 of the fixing roll 182. The release agent applicator system 200 is operable to apply an effective amount of the release agent to the outer surface 183 of the fixing roll 182 to produce robust images on the substrate 102 without image offset on the fixing roll 182. The applied amount of the release agent is also effective to control the amount of the release agent that is transferred to the substrate 102, i.e., the release agent carryout, to within a desired range.

The illustrated release agent applicator system 200 includes a release agent applicator 200. The release agent applicator 200 includes an applicator roll 212 having an outer surface 213. The applicator roll 212 can be comprised of a porous material, such as a polymer foam material. The material of the applicator roll 212 is chemically compatible with the release agent. For example, the applicator roll 212 can be comprised of an open-cell polyurethane material. The outer surface 213 is positioned in contact with the outer surface 183 of the fixing roll 182, typically at about an 8 o'clock position to about a 10 o'clock position. The applicator roll 212 is driven at a controlled speed to transfer release agent from the outer surface 213 to the outer surface 183 of the fixing roll 182. A perforated supply conduit 218, which is in communication with a supply of the release agent, is positioned to drip fresh release agent onto the outer surface 213 of the applicator roll 212 at a rate effective to continuously maintain a desired amount of the release agent on the outer surface 213 for applying to the fixing roll 182.

A tray 220 is positioned to collect residual release agent. The tray 220 can be connected to a reclamation system operable to filter the release agent to remove entrained contaminants, such as toner, paper particles, clay, dust, and the like. The reclamation system can deliver the as-filtered release agent to a pump, which delivers fresh release agent to the applicator roll 212 to maintain its saturation rate.

In other embodiments of the release agent applicator system 200, the applicator roll 212 can be positioned in contact with a supply of release agent contained in a sump. For example, the tray 220 can function as a sump. In these embodiments, the release agent is transferred from the sump to the outer surface 183 of the fixing roll 182 by rotation of the applicator roll 212. In these embodiments, the supply conduit 218 may be omitted. The applicator roll 212 can be comprised of any suitable non-conformable or conformable material (e.g., a polymer foam material) that allows transfer of the release agent from the sump to the outer surface 183 of the fixing roll 182 at the desired rate. In these embodiments, the release agent contained in the sump can be filtered to remove entrained contaminants to allow the release agent to be recycled.

In other embodiments of the release agent applicator system 200, the release agent can be applied to the outer surface 183 of the fixing roll 182 by a spraying device (not shown). In these embodiments, the applicator roll 212 is omitted and a collecting member, such as the tray 220, can be used to collect residual release agent, which can be subjected to filtration.

As shown, the release agent applicator system 200 includes a metering blade 230 positioned to level the release agent on the outer surface 183 of the fixing roll 182. The metering blade 230 can also remove contaminants from the release agent. The release agent is leveled on the outer surface 183 by the metering blade 230 to a film thickness effective to avoid off-set of the marking material on the substrate 102. The film thickness of the release agent on the outer surface 183 is also effective to control release agent carryout to the substrate 102 to within a desirable range. In the illustrated embodiment, the release agent is applied to the outer surface 183 of the fixing roll 182 by the applicator roll 212 at the fixing temperature and transferred to the substrate 102 at a temperature that may be close to the pre-heat temperature, depending on the amount of cooling of the substrate 102 between the pre-heating device 160 and the fixing device 180.

The metering blade 230 is attached to a support 230. The metering blade 230 is made of a material that is chemically compatible with the release agent, so that the metering blade 230 remains dimensionally stable during operation of the fixing device 180, and is able to continuously maintain the desired amount of the release agent on the outer surface 183 of the fixing roll 182. The metering blade 230 has sufficient durability to resist wear over prolonged usage. In an exemplary embodiment, the metering blade 230 is comprised of a urethane material having a hardness of at least 70 based on the Durometer hardness scale A. The free length and loading of the metering blade 230 can be set to provide the desired leveling performance. An exemplary embodiment of the metering blade 230 can have a thickness of about 2 mm and a free length of about 7 mm. A metering blade 230 comprised of urethane (or another polymer having suitable physical and chemical properties) can be used to deliver release agent to the outer surface 183 of the fixing roll 182 in a controlled manner and, when used in combination with a hard and smooth outer surface 183, such as anodized aluminum, can provide a substantially constant rate of release agent carryout to substrates over extended periods of operation of the fixing device 180.

The applicator roll 212 can supply the release agent to the outer surface 183 of the fixing roll 182 at a rate sufficient to provide some excess release agent to wash down the face of the metering blade 230 facing the outer surface 183, which can aid in preventing the build-up of contaminants on the surface.

In the fixing device 180, the use of lower fixing temperatures at the fixing nip 186 allows the use of release agents that have a lower viscosity (and vapor pressure) than release agents that are formulated for use at higher fixing temperatures. In embodiments, the release agent can have a kinematic viscosity of about 10 cST to about 300 cST, such as about 10 cST to about 200 cST, about 10 cST to about 100 cST, or about 50 cST to about 100 cST. The release agent is also chemically compatible with the materials of the applicator roll 212 and metering blade 230 and with the marking material, e.g., toner. In embodiments, the release agent contains silicone oil, and may also contain one or more additives. An exemplary release agent that can be used in the fixing device 180 is Copy Aid 270 silicone fluid available from Wacker Chemical Corporation of Adrian, Mich. This release agent comprises polydimethylsiloxane and polydimethylsiloxane with aminoalkyl groups, has a boiling point of >105° C., and has a kinematic viscosity of 80 $mm^2/s$ (80 cST).

In embodiments, the outer surface 183 of the fixing roll 182 can be heated to a temperature that is less than the boiling point of the release agent applied to the outer surface 183 of the fixing roll 182. For example, for a release agent having a boiling point of >105° C. (e.g., Copy Aid 270 silicone fluid), the temperature of the outer surface 183 can be maintained at less than 105° C., such as less than about 100° C. Typically, the outer surface 183 can be heated to a fixing temperature of from about 80° C. to about 100° C., such as about 90° C. to about 100° C., to fix different types of marking material onto substrates with the use of low-viscosity release agents.

It has been determined that the use of a release agent having a lower viscosity is also effective to reduce release agent consumption and allows effective post-processing operations of printed substrates. The use of a release agent having a lower viscosity allows a smaller amount (mass/unit area or thickness) of the release agent to be applied to the outer surface 183 of the fixing roll 182 by the release agent applicator system 200 to achieve the benefits of using the release agent because the lower-viscosity release agent can be leveled more effectively on the outer surface 183 by the metering blade 230 as compared to a higher-viscosity release agent. It has been determined that the use of the lower-viscosity release agent in combination with the metering blade 230 in the fixing device 180 can allow a release agent consumption rate as low as about 10% of the consumption rate for release agents having a higher viscosity.

Regarding post-processing operations for, e.g., a printed web, the web can be cut into sheets and these sheets can be bound using adhesive bonding. When an excessive amount of a release agent is transferred to the web, acceptable adhesive bonding of the cut sheets is not achievable. For a given porosity (permeability) of the web, increasing the viscosity of the release agent reduces the rate of permeation of the release agent into the web from the surface on which the release agent is applied. By using a lower viscosity release agent, the release agent can permeate into the web more quickly, resulting in a smaller amount of the release agent remaining on the imaged surface of sheets cut from the web at the time that post-processing operations, such as adhesive bonding, are performed. Consequently, acceptable adhesive bonding of the sheets can be achieved using webs processed in the fixing device 180 using lower viscosity release agents.

It has been determined that the minimum release agent carryout rate that provides acceptable image durability without offset is about 0.5 mg to about 1 mg per A4-sized sheet, depending on the media type. For example, a minimum amount of the release agent of about 0.5 mg/A4-sized sheet can be used for 20 lb. paper, while a larger amount of about 1 mg/A4-size sheet (215 mm×355 mm) can be used for more-absorbent paper, such as 24 lb. paper. Release agent carryout rates of more than about 10 mg/A-4 size sheet can prevent acceptable adhesive bonding of paper sheets. In embodiments, the release agent is applied to the fixing roll 182 in a controlled manner to allow a release agent carryout rate of about 0.5 mg to about 10 mg per A-4 size sheet, such as about 0.5 mg to about 5 mg per A-4 size sheet, to be achieved for paper sheets or webs, to achieve acceptable image durability without offset and acceptable adhesive bonding capability of sheets.

Embodiments of the fixing device 180 including the release agent applicator system 200 using a lower viscosity release agent and the metering blade 230 can achieve a release agent carryout rate that is within the desired range of about 0.5 mg to about 10 mg per A-4 size sheet for different media types. In addition, the release agent applicator system 200 can continue to provide consistent, low release agent carryout rates over the life of the fixing device 180.

In the fixing device 180, the use of contact pre-heating of the substrate 102 combined with use of a relatively lower temperature at the fixing nip 186 allows the use of toner materials having a lower melting temperature. For example, low-melting and ultra-low-melting toner materials that are characterized as having a melting temperature that is altered (lowered) by heating the toner to a temperature above a threshold temperature and then re-heating the toner having the lowered melting temperature, can be used in the fixing device 180. Exemplary ultra-low-melting toners having these characteristics comprise a crystalline polymer material, such as crystalline polyester material, and an amorphous polymer material, such as amorphous polyester material, with the amorphous material having a glass transition temperature ($T_g$) separate from the melting temperature ($T_m$) of the crystalline material. In these toners, the crystalline polymer material imparts a low melting temperature to the toner. Exemplary toners having alterable melting temperature characteristics that may be used in the fixing device are disclosed in U.S. Pat. Nos. 7,402,371; 7,494,757 and 7,547,499, each of which is incorporated herein by reference in its entirety.

Toners having such temperature-alterable melting characteristics can be used in the fixing device 180 to further enhance the effectiveness of the pre-heating of the substrate 102 and marking material in the fixing process. These toners can be caused to undergo a reduction in their melting temperature prior to fixing of the toner at the fixing nip 186 by pre-heating the substrate 102 and marking material using the pre-heating device 160. At the fixing nip 186, additional thermal energy is applied to the substrate 102 and toner with the heated fixing roll 182. By lowering the toner melting temperature by pre-heating, the process conditions of temperature, pressure and/or dwell can be lowered in the fixing nip 186.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fixing device for fixing marking material to a substrate, comprising:
- a first roll including an outer surface;
- a second roll forming a fixing nip with the outer surface of the first roll at which is received a pre-heated substrate on which marking material is disposed;
- a release agent applicator system comprising:
  - a supply of a release agent having a viscosity of from about 10 cST to about 300 cST; and
  - a release agent applicator for applying the release agent to the outer surface of the first roll; and
- a thermal energy source for heating the outer surface of the first roll to a temperature of less than a boiling point of the release agent;
- wherein the first roll and second roll are operable to apply heat and a pressure of at least about 500 psi to the pre-heated substrate and marking material at the fixing nip to fix the marking material to the substrate,
- wherein the marking material comprises dry toner, the toner comprising a crystalline polymer material and an amorphous polymer material, the toner having a melting temperature which is lowered by heating the toner to a temperature above a threshold temperature during the pre-heating of the substrate and marking material.

2. The fixing device of claim 1, wherein:
- the thermal energy source heats the outer surface of the first roll to a temperature of less than about 100° C.; and
- the first roll and second roll apply a pressure of about 500 psi to about 2500 psi to the pre-heated substrate and marking material at the fixing nip.

3. The fixing device of claim 1, wherein the thermal energy source comprises at least one heating element internal to the first roll for heating the outer surface.

4. The fixing device of claim 1, wherein the outer surface of the first roll comprises anodized aluminum.

5. The fixing device of claim 4, wherein the second roll comprises an outer surface comprising a polymer.

6. The fixing device of claim 1, wherein the release agent applicator comprises:
- a rotatable applicator roll including an outer surface positioned in contact with the outer surface of the first roll;
- a perforated supply conduit in communication with the supply of the release agent, the supply conduit being positioned to drip the release agent onto the outer surface of the applicator roll; and
- a metering blade for leveling the release agent on the outer surface of the first roll.

7. The fixing device of claim 1, wherein the release agent applicator comprises:
- an applicator roll including an outer surface positioned in contact with the outer surface of the first roll;
- a sump containing the supply of the release agent, the outer surface of the applicator roll being positionable to contact the release agent contained in the sump and being rotatable to transfer the release agent from the sump to the outer surface of the first roll; and
- a metering blade for leveling the release agent on the outer surface of the first roll.

8. A printing apparatus, comprising:
- a marking device for applying marking material to a substrate;
- a pre-heating device for pre-heating the substrate and marking material; and
- a fixing device for fixing the marking material to the pre-heated substrate, the fixing device comprising:
  - a first roll including an outer surface;
  - a second roll forming a fixing nip with the outer surface of the first roll at which the pre-heated substrate is received;
  - a release agent applicator system including:
    - a supply of a release agent having a viscosity of from about 10 cST to about 300 cST; and
    - a release agent applicator for applying the release agent to the outer surface of the first roll; and
  - a thermal energy source for heating the outer surface of the first roll to a temperature of less than a boiling point of the release agent;
- wherein the first roll and second roll are operable to apply heat and a pressure of at least about 500 psi to the pre-heated substrate and marking material at the fixing nip to fix the marking material to the substrate, wherein the marking material comprises a toner comprised of a crystalline polymer material and an amorphous polymer material, the toner having a melting temperature which is lowered by heating the toner to a temperature above a threshold temperature, and the marking device comprises at least one marking station, each marking station containing a supply of the marking material for applying to the substrate.

9. The printing apparatus of claim 8, wherein the marking material comprises dry toner.

10. The printing apparatus of claim 8, wherein:

the thermal energy source heats the outer surface of the first roll to a temperature of less than about 100° C.; and the first roll and second roll are operable to apply a pressure of about 500 psi to about 2500 psi to the pre-heated substrate and marking material.

11. The printing apparatus of claim 8, wherein the thermal energy source comprises at least one heating element internal to the first roll for heating the outer surface.

12. The printing apparatus of claim 8, wherein:

the outer surface of the first roll comprises anodized aluminum; and the second roll comprises an outer surface comprising a polymer.

13. The printing apparatus of claim 8, wherein the release agent applicator comprises:

a rotatable applicator roll including an outer surface positioned in contact with the outer surface of the first roll;

a perforated supply conduit in communication with the supply of the release agent, the supply conduit being positioned to drip the release agent onto the outer surface of the applicator roll; and a metering blade for leveling the release agent on the outer surface of the first roll.

14. The printing apparatus of claim 8, wherein the release agent applicator comprises:

an applicator roll including an outer surface positioned in contact with the outer surface of the first roll;

a sump containing the supply of the release agent, the outer surface of the applicator roll being positionable to contact the release agent contained in the sump and the applicator roll being rotatable to transfer the release agent from the sump to the outer surface of the first roll; and a metering blade for leveling the release agent on the outer surface of the first roll.

15. A method of fixing marking material to a substrate, comprising:

applying a marking material to a substrate with a marking device;

pre-heating the substrate and marking material with a pre-heating device;

feeding the pre-heated substrate to a fixing nip formed by an outer surface of a first roll and a second roll;

applying a release agent having a viscosity of from about 10 cST to about 300 cST to the outer surface of the first roll using a release agent applicator system;

heating the outer surface of the first roll to a temperature of less than a boiling point of the release agent with a thermal energy source; and applying heat and a pressure of at least about 500 psi to the pre-heated substrate and marking material at the fixing nip with the heated first roll and second roll to fix the marking material to the pre-heated substrate;

wherein the marking material comprises dry toner, the toner comprising a crystalline polymer material and an amorphous polymer material, the toner having a melting temperature which is lowered by heating the toner to a temperature above a threshold temperature during the pre-heating of the substrate and marking material.

16. The method of claim 15, wherein:

the thermal energy source heats the outer surface of the first roll to a temperature of less than about 100° C.; and the first roll and second roll apply a pressure of about 500 psi to about 2500 psi to the pre-heated substrate.

17. The method of claim 15, wherein the substrate and marking material are pre-heated to a temperature of less than about 100° C.

18. The method of claim 15, wherein applying the release agent comprises:

transferring the release agent from an outer surface of a rotatable applicator roll to the outer surface of the first roll; and leveling the release agent on the outer surface of the first roll with a metering blade.

19. The method of claim 15, wherein the substrate to which the marking Material has been fixed has a carryout rate of the release agent of about 0.5 mg to about 10 mg per A-4 size sheet.

* * * * *